US009428708B2

(12) United States Patent
Nomura et al.

(10) Patent No.: US 9,428,708 B2
(45) **Date of Patent: *Aug. 30, 2016**

(54) LUBRICATING COATING COMPOSITION AND ATTACHMENT COMPONENT FOR INTERNAL COMBUSTION ENGINE

(75) Inventors: Takuma Nomura, Komaki (JP); Masamichi Ito, Aichi (JP); Wakako Kinose, Nagoya (JP); Katsumi Sakamoto, Inabe (JP); Yutaka Kawamura, Inabe (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 23 days.

This patent is subject to a terminal disclaimer.

(21) Appl. No.: 14/343,697

(22) PCT Filed: May 22, 2012

(86) PCT No.: PCT/JP2012/003351

§ 371 (c)(1),
(2), (4) Date: Mar. 7, 2014

(87) PCT Pub. No.: WO2013/046489

PCT Pub. Date: Apr. 4, 2013

(65) Prior Publication Data

US 2014/0235514 A1 Aug. 21, 2014

(30) Foreign Application Priority Data

Sep. 30, 2011 (JP) ..... 2011-218135

(51) Int. Cl.
*C10M 111/04* (2006.01)
*C10M 107/50* (2006.01)
(Continued)

(52) U.S. Cl.
CPC ..... *C10M 111/04* (2013.01); *C10M 169/04* (2013.01); *C10M 2201/041* (2013.01);
(Continued)

(58) Field of Classification Search
CPC ..... C10M 111/04; C10M 169/04; C10M 2201/041; C10M 2201/061; C10M 2201/066; C10M 2201/087; C10M 2201/103; C10M 2203/06; C10M 2229/04; C10M 2229/025; C10N 2230/06; C10N 2230/08; C10N 2230/225012; C10N 2230/121; C10N 2230/141; F02D 41/1446
USPC ..... 508/107; 374/144
See application file for complete search history.

(56) References Cited

U.S. PATENT DOCUMENTS 4,029,472 A 6/1977 Micheli et al.
4,929,507 A * 5/1990 Nishihara et al. ..... 428/447
(Continued)

FOREIGN PATENT DOCUMENTS

CN 1974737 A 6/2007
JP 61-136013 A 6/1986
(Continued)

OTHER PUBLICATIONS

Communication dated Jan. 26, 2015, issued by the State Intellectual Property Office of the People's Republic of China in counterpart Application No. 201280048076.0.
(Continued)

*Primary Examiner* — James Goloboy
(74) *Attorney, Agent, or Firm* — Sughrue Mion, PLLC

(57) ABSTRACT

A solid coating film (41) is formed on a surface of a screw member (25) of a temperature sensor (1), serving as an internal combustion engine attachment component, by use of a lubricating coating composition containing, as solid ingredients for forming the coating film (41), an organosilicon polymer having a polycarbosilane skeleton cross-linked by a metallic element, and a solid lubricant composed of at least one member selected from among molybdenum disulfide, boron nitride, graphite, and mica, and an organic solvent serving as the solvent for the solid ingredients. By virtue of the coating film (41), high seizure resistance can be attained.

4 Claims, 2 Drawing Sheets

(51) Int. Cl.

| | |
|---|---|
| ***C10M 125/22*** | (2006.01) |
| ***C10M 169/04*** | (2006.01) |
| *F02D 41/14* | (2006.01) |

(52) U.S. Cl.

CPC .. *C10M2201/061* (2013.01); *C10M 2201/066* (2013.01); *C10M 2201/087* (2013.01); *C10M 2201/103* (2013.01); *C10M 2203/06* (2013.01); *C10M 2229/025* (2013.01); *C10M 2229/04* (2013.01); *C10N 2230/06* (2013.01); *C10N 2230/08* (2013.01); *C10N 2250/12* (2013.01); *C10N 2250/121* (2013.01); *C10N 2250/141* (2013.01); *F02D 41/1446* (2013.01)

(56) References Cited

U.S. PATENT DOCUMENTS

| | | | | |
|---|---|---|---|---|
| 2002/0039378 | A1 | 4/2002 | Shibayama | |
| 2003/0147452 | A1* | 8/2003 | Adachi et al. | 374/185 |
| 2007/0123436 | A1 | 5/2007 | Kato et al. | |
| 2009/0169900 | A1 | 7/2009 | Oberle et al. | |
| 2012/0021955 | A1 | 1/2012 | Kato et al. | |
| 2014/0235514 | A1 | 8/2014 | Nomura et al. | |
| 2014/0318228 | A1 | 10/2014 | Nomura et al. | |

FOREIGN PATENT DOCUMENTS

| | | | |
|---|---|---|---|
| JP | 62-54768 | A | 3/1987 |
| JP | 63-12672 | A | 1/1988 |
| JP | 2-134407 | A | 5/1990 |
| JP | 4-18456 | A | 1/1992 |
| JP | 2002-122486 | A | 4/2002 |
| JP | 2007-169597 | A | 7/2007 |
| JP | 2010-180360 | A | 8/2010 |
| JP | 2013-076036 | A | 4/2013 |

OTHER PUBLICATIONS

Communication dated May 26, 2016, issued by the Japan Patent Office in Japanese Application No. 2014-059261.

* cited by examiner

LUBRICATING COATING COMPOSITION AND ATTACHMENT COMPONENT FOR INTERNAL COMBUSTION ENGINE

CROSS REFERENCE TO RELATED APPLICATIONS

This application is a National Stage of International Application No. PCT/JP2012/003351, filed on May 22, 2012, which claims priority from Japanese Patent Application No. 2011-218135, filed on Sep. 30, 2011, the contents of all of which are incorporated herein by reference in their entirety.

TECHNICAL FIELD

The present invention relates to a lubricating coating composition which is applied to parts and components or the like employed at high temperature (e.g., 500 to 800° C.), and to a component to be attached to an internal combustion engine (hereinafter referred to as an "internal combustion engine attachment component"), which component has a solid coating film formed through application of the lubricating coating composition.

BACKGROUND ART

Conventionally, a thread portion and other portions of a metallic part which are required to be prevented from seizure are generally coated with a lubricant.

Examples of the metallic part include a metallic shell of a gas sensor, which is attached to an exhaust pipe or the like of an internal combustion engine for detecting a specific gas component in an analyte gas, and a tightening nut of a temperature sensor, which is attached to an exhaust pipe or the like for measuring the temperature of an analyte gas.

An example of the lubricant which has been proposed is a paste-like lubricant formed of a lube base oil or the like and a solid lubricant added to the base (see, for example, Patent Documents 1 and 2).

PRIOR ART DOCUMENT

Patent Document

Patent Document 1: Japanese Patent Application Laid-Open (kokai) No. 2010-180360

Patent Document 2: Japanese Patent Application Laid-Open (kokai) No. 2007-169597

SUMMARY OF THE INVENTION

Problems to be Solved by the Invention

However, in the aforementioned conventional technique, when a tightening nut is tightened after coating of the thread thereof with a paste-like lubricant, in some cases, the paste-like lubricant flows out from the screw engaged region, and a sufficient amount the paste-like lubricant fails to remain. When an oil-base lubricant is used, in some cases, the flowability of the lubricant increases as temperature rises, thereby causing sagging of the lubricant. In this case, sufficient seizure resistance fails to be attained.

When a high-flow lubricant is used, in some cases, there must be prevented deposition of the lubricant around working sites in relation to screw engaging, and release of the lubricant until completion of tightening, thereby problematically impairing workability.

The present invention has been conceived for solving the aforementioned problems, and an object of the present invention is to provide a lubricating coating composition which has excellent workability and which exhibits excellent seizure resistance. Another object is to provide an internal combustion engine attachment component, which has a solid coating film formed through application of the lubricating coating composition.

Means for Solving the Problems (1) In a first mode of the present invention for solving the aforementioned problems, there is provided a lubricating coating composition for forming solid coating film, characterized in that the composition comprises, as solid ingredients for forming the coating film, an organosilicon polymer having a polycarbosilane skeleton cross-linked by a metallic element, and a solid lubricant composed of at least one member selected from among molybdenum disulfide, boron nitride, graphite, and mica, and an organic solvent serving as the solvent for the solid ingredients.

(2) A second mode of the present invention is directed to a specific embodiment of the lubricating coating composition according to claim 1, wherein the composition contains the solid lubricant in an amount of 10 to 400 parts by weight, with respect to 100 parts by weight of the organosilicon polymer.

(3) A third mode of the present invention is directed to a specific embodiment of the lubricating coating composition according to claim 1 or 2, wherein the lubricating coating composition is applied onto a surface of a threaded portion of a screw member and forms the solid coating film by drying or heating the applied composition.

(4) In a fourth mode of the present invention, there is provided an internal combustion engine attachment component to be attached to an exhaust pipe of an internal combustion engine, wherein the component has a screw member having a threaded portion, and a coating film formed on a surface of the threaded portion, the coating film being formed of the solid ingredients of a lubricating coating composition as recited in any one of claims 1 to 3.

(5) A fifth mode of the present invention is a specific embodiment of the internal combustion engine attachment component according to claim 4, wherein the internal combustion engine attachment component is a temperature sensor comprising a heat-sensitive element whose electric property varies with temperature, and the screw member.

Effects of the Invention

When a solid coating film is formed on parts and components or the like whose seizure is to be prevented by use of the lubricating coating composition of the first mode, the parts and components or the like can exhibit sufficient seizure resistance at a temperature as high as 500° C. or higher (particularly 700 to 800° C.)

More specifically, among the solid ingredients of the lubricating coating composition for forming solid coating film, the aforementioned organosilicon polymer has sufficient heat resistance at high temperature (e.g., 500 to 800° C.). That is, the polymer is difficult to decompose by heat to volatilization or vaporization, or is difficult to cause heating loss. In addition, the aforementioned solid lubricant(s) can exhibit lubrication performance while the heat resistance thereof is maintained.

In other words, the solid coating film formed from the lubricating coating composition of the present invention has a structure in which a solid lubricant is dispersed in the organosilicon polymer. Therefore, impairment, removal, or the like of the solid coating film at high temperature is prevented, and seizure of parts and components or the like can be suitably prevented by completely covering the seizure prevention portions thereof.

The coating film formed from the lubricating coating composition of the present invention is solid. Thus, as compared with a conventional paste-like lubricant, flowing out of the coating in a screw member fastening procedure or at high temperature is prevented. In addition, the solid coating film is not deposited around working sites, thereby ensuring workability.

The second mode is a preferred embodiment of the lubricating coating composition. When the amount of solid lubricant with respect to 100 parts by weight of organosilicon polymer is less than 10 parts by weight, the formed coating film tends to crack, and the lubrication performance of the formed solid coating film may decrease, whereas when the amount of solid lubricant with respect to 100 parts by weight of organosilicon polymer is in excess of 400 parts by weight, the organosilicon polymer content of the solid coating film decreases. In this case, boding performance of components and parts to which seizure resistance is to be imparted; e.g., the bonding performance of the threaded portion of a screw product (i.e., bonding strength between coating film and threaded portion) may decrease. Thus, in order to attain high seizure resistance, the above compositional proportions are suited. More preferably, the composition contains the solid lubricant in an amount of 25 to 300 parts by weight with respect to 100 parts by weight of the organosilicon polymer.

In the third mode, the lubricating coating composition is applied to the surface of the threaded portion of the thread, and the coating composition is dried or heated, whereby a solid coating film can be readily formed on the surface of the threaded portion, and seizure of the threaded portion can be prevented.

In the internal combustion engine attachment component of the fourth mode to be attached to an exhaust pipe of an internal combustion engine, a coating film formed of the solid ingredients of the lubricating coating composition is formed on the surface of the thread portion of a screw member.

Therefore, even when the internal combustion engine attachment component is exposed to high-temperature conditions (e.g., 500 to 800° C.), seizure of the screwed region between the screw member of the internal combustion engine attachment component and an exhaust pipe or the like of the internal combustion engine (to which the screw member is attached) can be satisfactorily prevented.

The fifth mode is an embodiment of the internal combustion engine attachment component. In the temperature sensor having a heat-sensitive element and a screw member, seizure of the screwed region between the screw member and an exhaust pipe or the like of the internal combustion engine (to which the screw member is attached) can be satisfactorily prevented.

MODES FOR CARRYING OUT THE INVENTION

Figure 1:
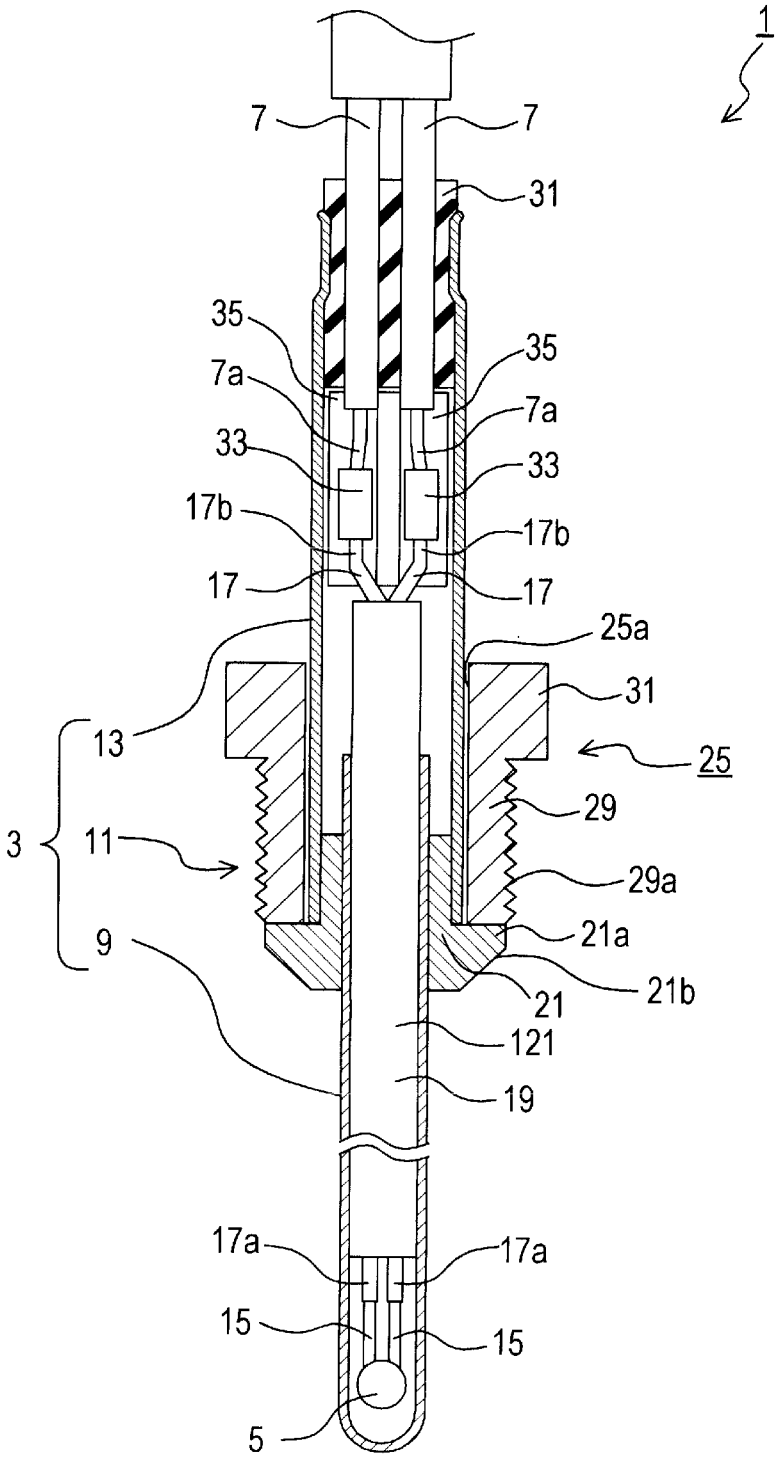
FIG. 1 is an exploded (in axial direction) cross-sectional view of a temperature sensor employed in Embodiment 1.

Modes for carrying out the present invention will next be described.

a) Firstly, the ingredients of the lubricating coating composition of the present invention will be described.

The lubricating coating composition of the present invention is a liquid composition in which the solid ingredients for forming solid coating film (dry coating film) are dissolved in organic solvent. The solid ingredients include an organosilicon polymer and a solid lubricant.

Among the solid ingredients, the organosilicon polymer is a polymer having a polycarbosilane skeleton (—(Si—C)$_n$—) in which the backbones are cross-linked with a metallic element such as Ti, Zn, Cr, or Mo (more specifically, an organometallic compound).

More specific examples of the organosilicon polymer include an organosilicon polymer represented by the following formula (1) cross-linked with an organometallic Ti compound, and an organosilicon polymer represented by the following formula (2) cross-linked with an organometallic Zn compound. Hereinafter, the organometallic compound represented by the following formula (1) may be referred to as a "tyranno resin."

[F1]

(1)

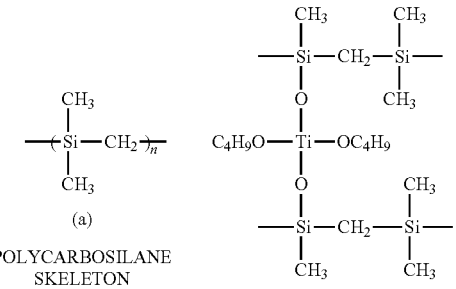

[F2]

(2)

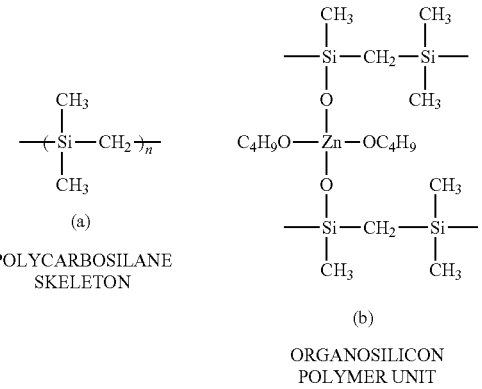

These organosilicon polymers undergo very small heating loss, when they are heated in air at 1,000° C. for 10 hours or longer. Therefore, shrinkage of the coating film due to heating loss, and cracking of the coating film are prevented, whereby the formed coating film has high density after curing.

By virtue of the above property, the organosilicon polymer can be maintained at high temperature, while the solid lubricant is dispersed therein. More specifically, deterioration of the organosilicon polymer is prevented at high temperature, for example, 500 to 800° C. That is, decomposition of the polymer, leading to volatilization/vaporization and heating loss, can be prevented, and the polymer reliably covers the surface of an article whose seizure is to be prevented (e.g., the threaded portion of a screw member). As a result, high seizure resistance can be attained by the solid lubricant dispersed and maintained in the organosilicon polymer.

Examples of the solid lubricant—another solid ingredient—include molybdenum disulfide, boron nitride, graphite, and mica. These materials may be used singly or in combination of two or more species.

As described above, the solid lubricant is present at, for example, the entire surface of the threaded portion of the screw member, such that the solid lubricant is dispersed and maintained in the organosilicon polymer, whereby seizure of the screw member or the like at high temperature can be prevented.

No particular limitation is imposed on the solvent for the solid ingredients, and a variety of organic solvents may be used.

For example, an aromatic hydrocarbon, a ketone solvent, or an ester solvent may be used. Specific examples of the solvent which may be employed in the invention include xylene, toluene, methyl ethyl ketone (MEK), methyl isobutyl ketone (MIBK), n-butyl acetate, and ethyl acetate.

The ratio of the amount of solid ingredients and that of organic solvent may be adjusted to attain a concentration and a viscosity of interest (in consideration of use conditions and other conditions). The organic solvent may be used in an amount of 55 to 1,900 parts by weight, with respect to 100 parts by weight of the solid ingredients.

In addition to the solid ingredients and organic solvent, the composition of the invention may appropriately contain a wet-dispersant, a leveling agent, a sedimentation inhibitor, or the like.

b) Next, a specific embodiment of the method for producing the lubricating coating composition of the present invention will be described.

In one procedure, a solid lubricant (10 to 400 parts by weight) is added to an organosilicon polymer (100 parts by weight), to thereby prepare a solid ingredient. Then, an organic solvent (55 to 1,900 parts by weight) is added to the solid ingredient (100 parts by weight).

The thus-obtained mixture is agitated by means of, for example, a dissolver agitator. Subsequently, the solid ingredient is dispersed in the polymer by means of, for example, a wet-medium agitation mill, to thereby prepare the solid lubricating coating composition of the present invention.

c) Then, a specific example of the application mode of use of the lubricating coating composition of the present invention.

Firstly, a member on which a solid coating film is to be formed, for example, a thread portion of a screw member (i.e., a portion provided with an external thread or an internal thread) is degreased.

Then, the degreased surface is subjected to a treatment, for example, an under layer treatment, in order to enhance adhesion of the coating film to the surface. Examples of the under layer treatment include chemical conversion such as phosphating, oxalating, or nitriding; physical treatment such as shot blasting; and surface modification such as plating.

Then, the material used in the under layer treatment is washed, after completion of the under layer treatment.

Then, the lubricating coating composition of the present invention is applied to a coating target member, for example, a screw member or the like, to thereby form a solid coating film. The lubricating coating composition is applied onto the surface of the coating target member through a technique such as spraying (e.g., air spraying), immersion, brush coating, or tumbling.

The thus-formed coating film is dried at ambient temperature to cure, or heated (fired) to cure. In one preferred procedure, firing is performed at 250 to 300° C. for 10 to 60 minutes. More specifically, firing at 280° C. for 30 minutes is preferred.

The formed coating film preferably has a thickness of 5 μm or more. When the coating film thickness is less than 5 μm, seizure resistance may decrease. No particular limitation is imposed on the upper limit of the coating film thickness, so long as screwing of a screw member is not impaired. In consideration of cost for coating film formation and other factors, the coating film thickness is 400 μm (preferably 300 μm) or less.

Embodiment 1

Specific examples of the present invention will next be described.

In Embodiment 1, the Examples (samples Nos. 1 to 18) of lubricating coating compositions, and Comparative Example (falling outside the scope of the present invention) will be described.

Through the aforementioned lubricating coating composition production method, lubricating coating compositions—samples Nos. 1 to 18 in TABLE 1—were prepared. TABLE 1 shows compositional proportions of solid ingredients. As an organic solvent, xylene was used in an amount of 900 parts by weight with respect to 100 parts by weight of solid ingredients.

Figure 3:
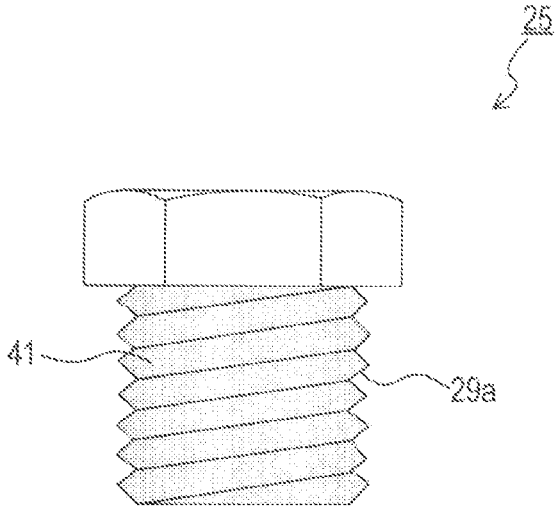
FIG. 3 is a sketch of a screw member attached to the temperature sensor, and a solid coating film formed thereon.

Each lubricating coating composition sample was applied to the entire outer surface of a threaded portion (external thread) of a test screw member (see FIG. 3), and baked at 280° C. for 30 minutes, to thereby form a solid coating film having a thickness of 10 μm (gray part in FIG. 3). Except the external thread, the screw member was masked, and only the external thread was coated. In Comparative Example, no solid coating film was formed, and instead, a paste-like lubricant "Never Seez" was applied to only the external thread.

The test screw members are each made of SUS 430. Each employed screw member had a nominal diameter of M12 (external thread), a thread length (i.e., axial length of external thread) of 13.5 mm, and a thread pitch of 1.25 mm.

After formation of coating film, the appearance of each screw member was visually observed. TABLE 1 shows the results.

In the column "APPEARANCE AFTER COATING" of TABLE 1, the symbol "OO" indicates that no crack was observed in coating film of all the evaluated 10 screw members; "O" indicates no crack was observed in ≥80% area of the coating film of evaluated 10 screw members; and "X" indicates no crack was observed in <80% area of the coating film of evaluated 10 screw members.

Separately, a boss (nut) made of SUS 430 and having an internal thread to be screwed with the screw member was provided. The screw member (having a coating film) was screwed into the internal thread of the boss. The internal thread of the boss had a nominal diameter of M12, and a thread pitch of 1.25 mm.

Then, the screw member was tightened at a tightening torque of 50 N·m, and the screw member and the boss were heated. More specifically, the pair was heated from room temperature (25° C.) to a high temperature (800° C.) at a temperature elevation rate of 150° C./h. Then, heating was stopped, and the pair was allowed to stand to cool to room temperature.

Thereafter, the screw member was removed from the boss, and seizure of the screw member was evaluated. TABLE 1 shows the results.

In the column of "SEIZURE EVALUATION" of TABLE 1, the symbol "OO" indicates that no damage was observed in the outer surface of the thread of all the three evaluated screw members (i.e., seizure was completely prevented); "O" indicates that no damage was observed in the outer surface of the thread of two of the three evaluated screw members; and "X" indicates that damage was observed in all the three evaluated screw members.

TABLE 1

| SAMPLES NO. | | TYRANNO RESIN [WT. PARTS] | SOLID LUBRICANTS (ADDITIVE) Mo DISULFIDE [WT. PARTS] | BORON NITRIDE [WT. PARTS] | GRAPHITE [WT. PARTS] | MICA [WT. PARTS] | SEIZURE EVALUATION | APPEARANCE AFTER COATING |
|---|---|---|---|---|---|---|---|---|
| EXAMPLES | 1 | 100 | 100 | — | — | — | OO | OO |
| | 2 | 100 | 150 | — | — | — | OO | OO |
| | 3 | 100 | 200 | — | — | — | OO | OO |
| | 4 | 100 | 5 | — | — | — | O | O |
| | 5 | 100 | 25 | — | — | — | OO | OO |
| | 6 | 100 | 50 | — | — | — | OO | OO |
| | 7 | 100 | — | 50 | — | — | O | OO |
| | 8 | 100 | — | 100 | — | — | OO | OO |
| | 9 | 100 | — | — | — | 100 | OO | OO |
| | 10 | 100 | — | 25 | — | 75 | OO | OO |
| | 11 | 100 | — | 75 | — | 25 | OO | OO |
| | 12 | 100 | 50 | 50 | — | — | OO | OO |
| | 13 | 100 | 50 | — | 50 | — | OO | OO |
| | 14 | 100 | 50 | — | — | 50 | OO | OO |
| | 15 | 100 | — | — | 100 | — | OO | OO |
| | 16 | 100 | 250 | — | — | — | OO | OO |
| | 17 | 100 | 300 | — | — | — | OO | OO |
| COMP. EXAMPLE | | | | Never Seez applied | | | X | Not evaluated |

As is clear from TABLE 1, the samples Nos. 1 to 18 falling within the scope of the present invention (i.e., having a solid coating film) were found to have less cracks in the coating films thereof after application of the coating composition, have good appearance, and provide excellent seizure resistance. In contrast, the sample of Comparative Example (i.e., having no solid coating film) provided poor seizure resistance, which is not preferred.

Notably, when the organosilicon polymer represented by the aforementioned formula (2), or a polymer having a polycarbosilane skeleton in which the backbones are cross-linked with a metallic element of Cr or Mo was used instead of the tyranno resin, the same effects can be attained.

Embodiment 2

Embodiment 2 is directed to a temperature sensor employing a screw member having a solid coating film which has been formed through application of a lubricating coating composition falling within the scope of the present invention.

Embodiment 2 is described, taking as an example a temperature sensor for measuring the temperature of exhaust gas, which sensor is attached to an exhaust pipe of an automobile internal combustion engine.

a) Firstly, the configuration of the temperature sensor of Embodiment 2 will be described.

As shown in FIG. 1, a temperature sensor 1 of Embodiment 2 includes a housing 3; a thermistor 5 placed in the housing 3 and serving as a heat-sensitive element that can output an electric signal converted from an electrical property varying depending on temperature; and a pair of leads 7 for outputting the electric signal provided from the thermistor 5 to the outside of the housing 3.

More specifically, the housing 3 consists of a first housing 9 located on the forward end side (the lower side in FIG. 1), an intermediate potion 11, and a second housing 13 located on the base end side (the upper side in FIG. 1).

The first housing 9 assumes a cylindrical tubular shape, with its forward end being closed. In the forward end part of the first housing 9, the thermistor 5 is disposed. The electric signal converted from the electrical property varying depending on temperature is from a pair of electrodes 15 of the thermistor 5. The two electrodes 15 are connected to first ends 17*a* of a pair of core wires 17. The two core wires 17 are covered with a sheath 19 (insulator), and the base end of the sheath 19 protrudes from the first housing 9.

The second housing 13 assumes a cylindrical tubular shape and has a diameter larger than that of the first housing 9. The second housing 13 and the first housing 9 are co-axially disposed such that a forward end portion of the second housing 13 overlaps with a base end portion of the first housing 9, and are connected to each other at the rear end of the tubular member 21.

Figure 2:
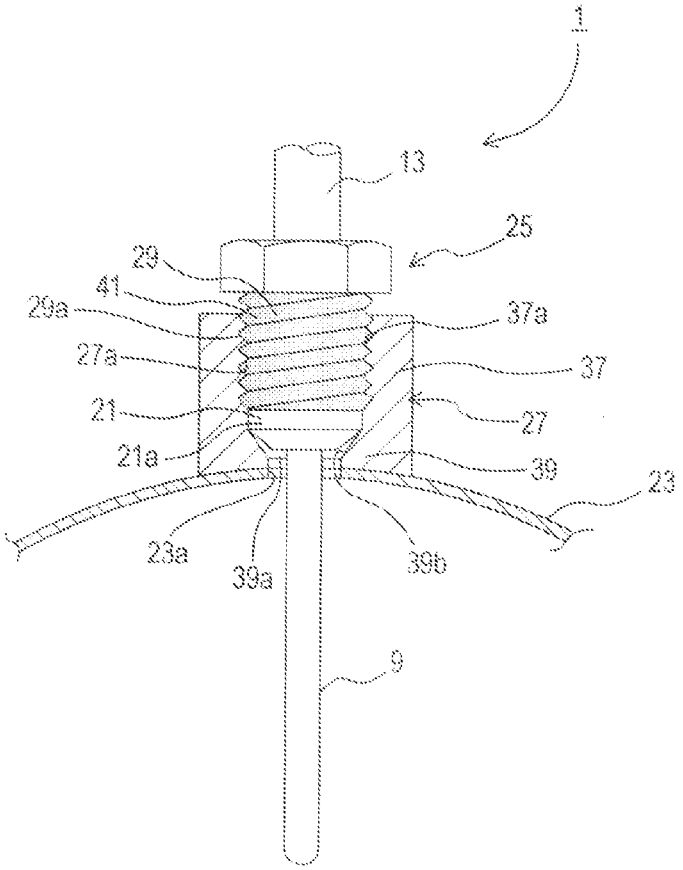
FIG. 2 is an exploded cross-sectional enlarged view of an essential portion of the temperature sensor employed in Embodiment 1 when attached to an exhaust pipe.

The intermediate portion 11 consists of a tubular member 21 that prevents leakage of the exhaust gas whose temperature is to be measured, and a screw member 25 for fixing the temperature sensor 1 to an exhaust pipe 23 (see FIG. 2). Notably, the screw member 25 works as a tightening nut.

The tubular member 21 is fixed to the base end of the first housing 9, and the forward end of the second housing 13 is fixed to the outer peripheral surface of a rear end portion of the tubular member 21. The tubular member 21 has a protrusion 21*a* which protrudes in a radial direction, and the forward end of the protrusion 21*a* has a tapered surface 21*b*.

The screw member 25 is rotatably disposed around the outer surface of the second housing 13 side portion of the tubular member 21. The screw member 25, serving as a member which is to be in screw engagement with a boss 27 (see FIG. 2), has a center hole 25*a* at the axial center, a thread portion 29 having an external thread 29*a* on the outer surface thereof, and a hexagonal nut portion 31 formed at the base end of the thread portion 29.

In the second housing 13, second ends 17*b* of the core wires 17 protruding from the base end of the first housing 9 are connected to first ends 7*a* of the leads 7 by means of crimping terminals 33. In addition to the crimping terminals 33, the second ends 17*b* of the core wires 17 and the first ends 7*a* of the leads 7 are covered with insulating tubes 35.

A grommet 31 made of heat-resistant rubber is fixed to the base end of the second housing 13 through crimping. The pair of leads 7 penetrates the grommet 31 and protrudes from the base end of the second housing 13.

b) Next, an attachment structure in which the temperature sensor 1 is attached to the exhaust pipe 23 will be described.

FIG. 2 shows the structure for attaching the temperature sensor 1. In the present embodiment, the temperature sensor 1 is attached to the exhaust pipe 23 of a vehicle in the direction orthogonal to the axis of the pipe. The sensor 1 is employed for detecting the temperature of exhaust gas in a wide range.

In the structure for attaching the temperature sensor 1, the boss 27 is joined through welding to the exhaust pipe 23, such that the center hole 27*a* of the boss 27 communicates with a through-hole 23*a* provided in the exhaust pipe 23. A forward end portion of the first housing 9 of the temperature sensor 1 protrudes through the through-hole 23*a* of the exhaust pipe 23 to the inside of the exhaust pipe 23.

The boss 27, which is a member to which the screw member 25 is fixedly screwed, has a thread portion 37 having an internal thread 37*a* formed on the wall surface of a center hole 27*a* of the boss 27, and a connection portion 39 located closer to the exhaust pipe 23 than the thread portion 37. The connection portion 39 is provided with an insertion hole 39*a* having a diameter smaller than the minimum diameter of the thread portion 37. The inner wall of the insertion hole 39*a* has a tapered surface 39*b*.

The tubular member 21 is made of SUS 310, and the screw member 25 is made of SUS 430. The boss 27 is made of SNB 16.

In the structure for attaching the temperature sensor 1, the screw member 25 is not fixed to the tubular member 21 or to the second housing 13, and is rotatable. The temperature sensor 1 is attached to the exhaust pipe 23 by use of the screw member 25 in the following manner.

Firstly, the first housing 9 of the temperature sensor 1 located on the forward end side thereof is inserted to the center hole 27*a* of the boss 27 and the through-hole 23*a* of the exhaust pipe 23. Also, the tubular member 21 (integrated with first housing 9) and a forward end portion of the second housing 13 are inserted into the center hole 27*a* of the boss 27, whereby the tubular member 21 is seated on the tapered surface 39*b* of the insertion hole 39*a* of the boss 27.

In this state, the external thread 29*a* of the thread portion 29 of the screw member 25 is brought into screw engagement with the internal thread 37*a* of the thread portion 37 of the boss 27. Through screwing the screw member 25 into the boss 27 with a predetermined tightening torque, the screw member 25 is fixed to the boss 27.

At that time, the upper surface of the protrusion 21*a* of the tubular member 21 is pressed against the forward end surface of the screw member 25, whereby the temperature sensor 1 is fixed to the boss 27 (i.e., the exhaust pipe 23).

Particularly, in this embodiment, as shown in FIGS. 2 and 3, a solid coating film (gray parts in FIGS. 2 and 3) 41 which has a thickness, for example 10 μm and which is formed of the solid ingredients of the lubricating coating composition is formed, so as to cover the entire outer peripheral surface of the external thread 29*a* of the screw member 25.

In one process for forming the solid coating film 41, the screw member 25 is masked except for the external thread 29*a*, and the lubricating coating composition is applied through, for example, spraying, to the surface of the external thread 29*a*, followed by heat-drying the applied coating composition.

An example of the solid coating film 41 is composed of a tyranno resin, and molybdenum disulfide serving as a solid lubricant uniformly dispersed in the tyranno resin. Notably, the coating film 41 contains a tyranno resin (100 parts by weight) and a solid lubricant (150 parts by weight, additional).

Thus, when the screw member 25 coated with the solid coating film 41 is screwed into the boss 27, the solid coating film 41 is disposed between the outer peripheral surface of the external thread 29*a* of the screw member 25 and the inner peripheral surface of the internal thread 37*a* of the boss 27, without flowing to the outside observed in the case of a grease-like lubricant.

As described, the solid coating film 41 exhibits excellent seizure resistance, even when exposed to high temperature conditions (e.g., 500 to 800° C.). Therefore, even when the exhaust pipe 23 is in a high-temperature state, seizure of the screw member 25 and the boss 27 can be prevented. Thus, the screw member 25 can be removed from the boss 27; i.e., the temperature sensor 1 can be removed from the exhaust pipe 23, with an appropriate torque (lower than a predetermined tightening torque).

The thus-formed solid coating film 41 does not deposit around working sites, providing advantageously excellent workability.

Several embodiments of the present invention have been described hereinabove. However, the present invention is not limited to the embodiments, and various modifications may be acceptable.

For example, the present invention may be applied not only to a temperature sensor, but also to a variety of sensors (e.g., an oxygen sensor).

DESCRIPTION OF REFERENCE NUMERALS

1 temperature sensor
5 heat-sensitive element
23 exhaust pipe
25 screw member
27 boss
29, 37 thread portion
29*a* external thread
37*a* internal thread
41 coating film

The invention claimed is:

1. An internal combustion engine attachment component to be attached to an exhaust pipe of an internal combustion engine, characterized in that the component has a screw member having a threaded portion, and, a coating film formed on a surface of the threaded portion, the coating film being formed of solid ingredients of a lubricating coating composition; and the composition comprises, as the solid ingredients for forming the coating film, an organosilicon polymer having a polycarbosilane skeleton cross-linked by a metallic element, and a solid lubricant consisting of molybdenum disulfide, and an organic solvent serving as the solvent for the solid ingredients, wherein the composition contains the solid lubricant in an amount of 25 to 300 parts by weight, with respect to 100 parts by weight of the organosilicon polymer, and all of the solid lubricant present in the composition consists of molybdenum disulfide.

2. An internal combustion engine attachment component according to claim 1, having the coating film formed of the solid ingredients of the lubricating coating composition, wherein the composition is applied onto the surface of the threaded portion of the screw member and forms the solid coating film by drying or heating the applied composition.

3. An internal combustion engine attachment component according to claim 1, wherein the internal combustion engine attachment component is a temperature sensor comprising a heat-sensitive element whose electric property varies with temperature, and the screw member.

4. An internal combustion engine attachment component to be attached to an exhaust pipe of an internal combustion engine, characterized in that the component has a screw member having a threaded portion, and, a coating film formed on a surface of the threaded portion, the coating film being formed of solid ingredients of a lubricating coating composition; and the composition comprises, as the solid ingredients for forming the coating film, an organosilicon polymer having a polycarbosilane skeleton cross-linked by a metallic element, and a solid lubricant composed of at least one member selected from among molybdenum disulfide, boron nitride, graphite, and mica, and an organic solvent serving as the solvent for the solid ingredients, wherein an under layer treatment is administered to the threaded portion of the screw member where the coating film will be formed to enhance adhesion of the coating film, and the composition is applied onto the surface of the treated threaded portion of the screw member and the solid coating film is formed by drying or heating the applied composition.

* * * * *